US008628155B1

(12) United States Patent
Nielson

(10) Patent No.: US 8,628,155 B1
(45) Date of Patent: Jan. 14, 2014

(54) INFINITELY ADJUSTABLE, CUSTOMIZABLE AND NON-SLIP DRAWER ORGANIZER

(76) Inventor: Keith M. Nielson, Traverse City, MI (US)

( * ) Notice: Subject to any disclaimer, the term of this patent is extended or adjusted under 35 U.S.C. 154(b) by 11 days.

(21) Appl. No.: 12/967,490

(22) Filed: Dec. 14, 2010

Related U.S. Application Data

(60) Provisional application No. 61/284,175, filed on Dec. 14, 2009.

(51) Int. Cl.
*A47B 81/00* (2006.01)

(52) U.S. Cl.
USPC ..... 312/212; 108/26; 206/372

(58) Field of Classification Search
USPC ..... 108/25, 26, 55.1, 54.1; 312/212, 211; 206/558, 350, 553, 372, 373, 349; 220/495.01, 23.87, 23.88, 23.9
See application file for complete search history.

(56) References Cited

U.S. PATENT DOCUMENTS

| | | | | | |
|---|---|---|---|---|---|
| 1,594,401 | A | * | 8/1926 | Zeitung | 206/553 |
| D160,314 | S | * | 10/1950 | Fuller | D7/637 |
| 2,980,241 | A | * | 4/1961 | Howell, Jr. et al. | 206/553 |
| 3,868,016 | A | * | 2/1975 | Szpur et al. | 206/565 |
| D275,921 | S | | 10/1984 | Ward | |
| 4,570,792 | A | * | 2/1986 | Conway | 206/372 |
| 4,705,168 | A | | 11/1987 | Ward | |
| 4,786,785 | A | * | 11/1988 | Felt | 312/211 |
| 5,044,059 | A | * | 9/1991 | De Giulio | 211/151 |
| 5,080,023 | A | * | 1/1992 | Miura et al. | 108/55.3 |
| 5,320,223 | A | * | 6/1994 | Allen | 206/372 |
| 5,339,955 | A | * | 8/1994 | Horan et al. | 206/350 |
| 5,388,694 | A | * | 2/1995 | Arendt | 206/373 |
| 5,468,062 | A | * | 11/1995 | Finnegan | 312/298 |
| 6,044,773 | A | * | 4/2000 | Bauer | 108/55.3 |
| 7,380,894 | B2 | * | 6/2008 | Berger | 312/348.3 |
| 7,410,053 | B2 | * | 8/2008 | Bowen et al. | 206/373 |
| 8,028,631 | B2 | * | 10/2011 | Lauzier et al. | 108/55.3 |
| 8,047,373 | B2 | * | 11/2011 | Murphy | 206/553 |
| 2002/0023855 | A1 | * | 2/2002 | Cho | 206/373 |
| 2005/0258059 | A1 | * | 11/2005 | Joyce et al. | 206/350 |
| 2006/0070900 | A1 | * | 4/2006 | Brunson et al. | 206/373 |
| 2006/0157364 | A1 | * | 7/2006 | Sproul et al. | 206/372 |
| 2007/0262038 | A1 | * | 11/2007 | Harbison et al. | 211/162 |
| 2009/0071854 | A1 | * | 3/2009 | Martin | 206/373 |
| 2009/0188931 | A1 | * | 7/2009 | Liu | 206/373 |

* cited by examiner

*Primary Examiner* — Jose V Chen
(74) *Attorney, Agent, or Firm* — Gardner, Linn, Burkhart & Flory, LLP

(57) ABSTRACT

A drawer organizer for use in a drawer, the drawer organizer being installed in a drawer and receiving utensils for storage in the drawer. The drawer organizer includes a base liner having an upper surface and a bottom surface, and includes multiple separate retaining members that may be selectively positioned and affixed to the upper surface of the base liner. The bottom surface of the base liner is placed on a base surface of a drawer and the retaining members are selectively positioned on the upper surface to retain utensils in a desired position on the drawer organizer.

21 Claims, 6 Drawing Sheets

INFINITELY ADJUSTABLE, CUSTOMIZABLE AND NON-SLIP DRAWER ORGANIZER

CROSS REFERENCE TO RELATED APPLICATION

The present application claims priority of U.S. provisional application, Ser. No. 61/284,175 filed Dec. 14, 2009, by Keith M. Nielson, which is hereby incorporated herein by reference in its entirety.

FIELD OF THE INVENTION

The present invention is directed to a drawer organizer, and more specifically to an adjustable and customizable drawer organizer.

BACKGROUND OF THE INVENTION

Drawer organizers are known devices inserted into drawers for receiving items such as cooking utensils. Such devices include rigid plastic constructions, such as made by injection molding or vacuum forming, with a set design of cavities or the like for receiving the utensils. Drawer organizers provided with the ability to be expanded in a single direction, such as length or width, provide only limited adjustability. In contrast, cooking utensils come in many various sizes and shapes whereby the conventional drawer organizers are rarely appropriate for receiving the myriad of utensils that may be stored therein. Moreover, the rigid plastic configurations may be prone to slipping when a drawer is opened and closed due to the typically hard, smooth surface of the drawer into which the drawer organizer is inserted.

SUMMARY OF THE INVENTION

The present invention provides an adjustable drawer organizer that is able to be configured into a customized configuration as desired by a user, such as based on the type, size and number of utensils to be stored on the organizer. In one embodiment of the present invention a flexible base liner may be trimmed to a desired shape for insertion into a drawer. One or more retaining members of any of various shapes and sizes may then be selectively positioned on the base liner to arrange and or create receptacles for receiving utensils. The retaining members are selectively affixed to the base liner, such as by a user, to create a customized configuration based on the type, size and number of utensils to be stored. The retaining members may be affixed to the base liner via the natural tackiness of the base liner material and/or retaining member material, or alternatively by double sided adhesive tape, hook and loop fastener material, magnetic attraction, or the like.

According to an aspect of the present invention, a drawer organizer for use in a drawer, the drawer organizer being installed in a drawer and receiving utensils for storage in the drawer, comprises a base liner and a plurality of separate retaining members. The base liner has an upper surface and a bottom surface with the bottom surface being placed on a base surface of the drawer and the retaining members being selectively positioned and affixed to the upper surface of the base liner by a user, the retaining members being selectively positioned on the upper surface to retain utensils in a desired position on the drawer organizer.

In particular embodiments the base liner may comprise a flexible mat. The retaining members may be affixed to the upper surface of the base liner by the natural attraction or tackiness between the base liner and retaining members, or by double sided adhesive tape, hook and loop connectors, or magnetically. The retaining members may comprise a number of alternative shapes and configurations, as well as may be pliable to selectively shape the retaining member into a desired orientation, and may include a stiffener or stiffening member, such as a wire, to aid in holding the retaining member in a desired position.

A retaining member may include a bottom portion and a top portion, with the top portion being positioned above the bottom portion to form a cavity between the top and bottom portions, with the top portion including apertures for receiving a utensil. Such a retaining member may be placed on a base liner, or may alternatively be affixed directly to the bottom surface of a drawer.

According to another aspect of the present invention, a method of organizing a drawer comprises providing a base liner for insertion into a drawer, where the base liner has top and bottom surfaces, inserting the base liner into a drawer such that the bottom surface contacts a base surface of the drawer, and selectively affixing a plurality of retaining members to the top surface of the base liner to create receptacles for receiving utensils. The base liner may be flexible whereby the method may also include trimming the base liner prior to insertion into the drawer.

The organizer in accordance with the present invention provides a flexible and configurable device to create desired arrangements for accommodating any of numerous types and styles of utensils that may be stored on the organizer, such as within a drawer. A base liner may be installed within the drawer, whereby any of variously shaped retaining members may be selectively arranged on the base liner to create a desired configuration for receiving utensils. The retaining members may be affixed to the base liner by the natural attraction of the materials, or alternatively by way of an adhesive member, such as double sided tape or a liquid adhesive. Still further, hook and loop fasteners or magnetic elements may be employed for securing the retaining members. Alternatively, retaining members may be secured directly to the base surface of a drawer.

These and other objects, advantages, purposes and features of this invention will become apparent upon review of the following specification in conjunction with the drawings.

DESCRIPTION OF THE PREFERRED EMBODIMENTS

The present invention will now be described with reference to the accompanying figures, wherein the numbered elements in the following written description correspond to like-numbered elements in the figures.

Figure 1:
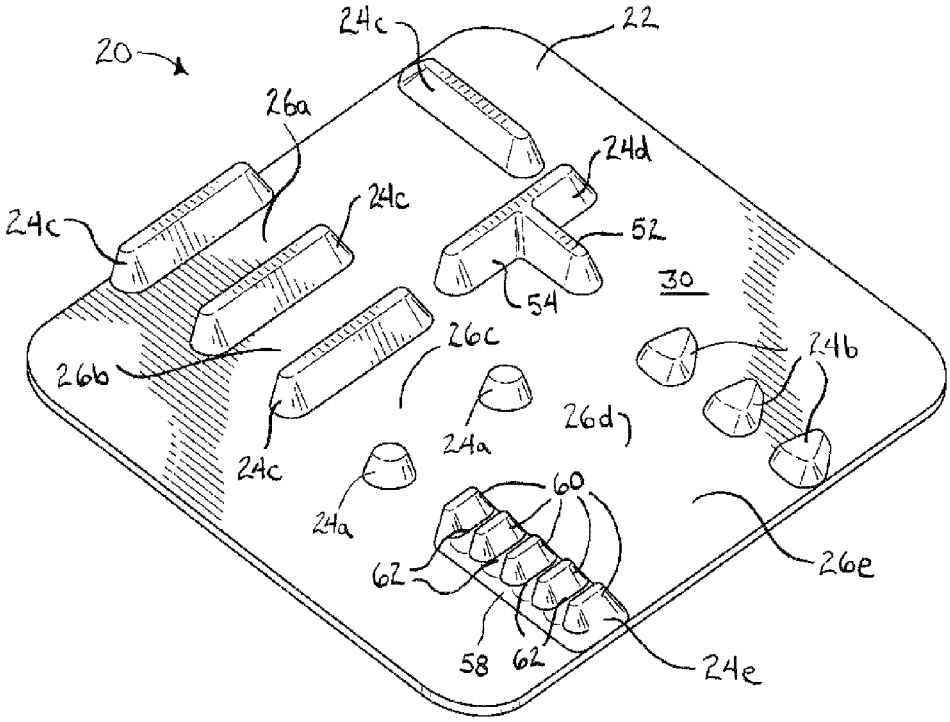
FIG. 1 is a perspective view of a drawer organizer in accordance with the present invention, with the drawer organizer including a base liner and multiple variously configured retaining members selectively positioned on the base liner.
Figure 2:
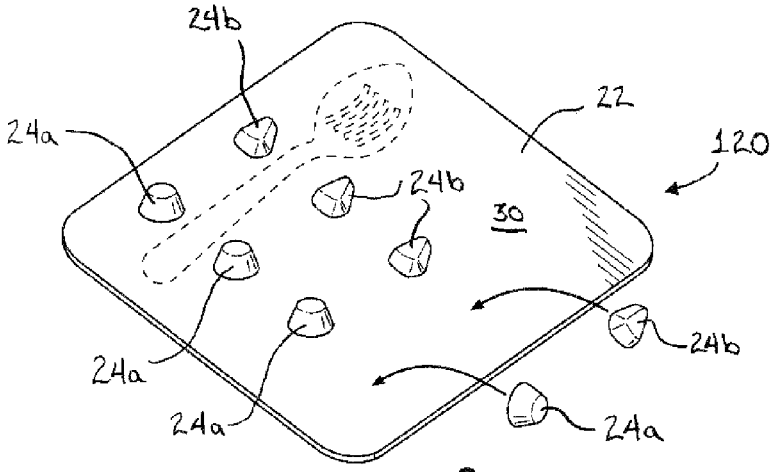
FIG. 2 is a perspective view of an alternative drawer organizer in accordance with the present invention comprising an alternative arrangement of retaining members on the base liner.

A drawer organizer 20 in accordance with one embodiment of the present invention is illustrated in FIG. 1 and includes a base drawer liner or base liner 22 and multiple variously configured retaining barriers or retaining members 24*a*, 24*b*, 24*c*, 24*d* and 24*e* that are selectively positioned and affixed to the base liner 22, such as by a user, to customize or adjust the configuration of the organizer 20 based on the particular utensil or utensils that may be stored in the drawer, with the various retaining members creating receptacles 26*a*, 26*b*, 26*c*, 26*d*, 26*e* for receiving the utensils in a manner whereby the utensils are constrained within a desired orientation. Organizer 20 thereby provides a flexible and configurable device whereby the arrangement of organizer 20 may be customized in a preferential arrangement to accommodate any of numerous types and styles of utensils that may be stored in a drawer 28 (FIG. 10) using organizer 20. For example, an alternatively arranged drawer organizer 120 is illustrated in FIG. 2 that includes base liner 22 and alternatively arranged or positioned retaining members 24*a* and 24*b*.

Figure 10:
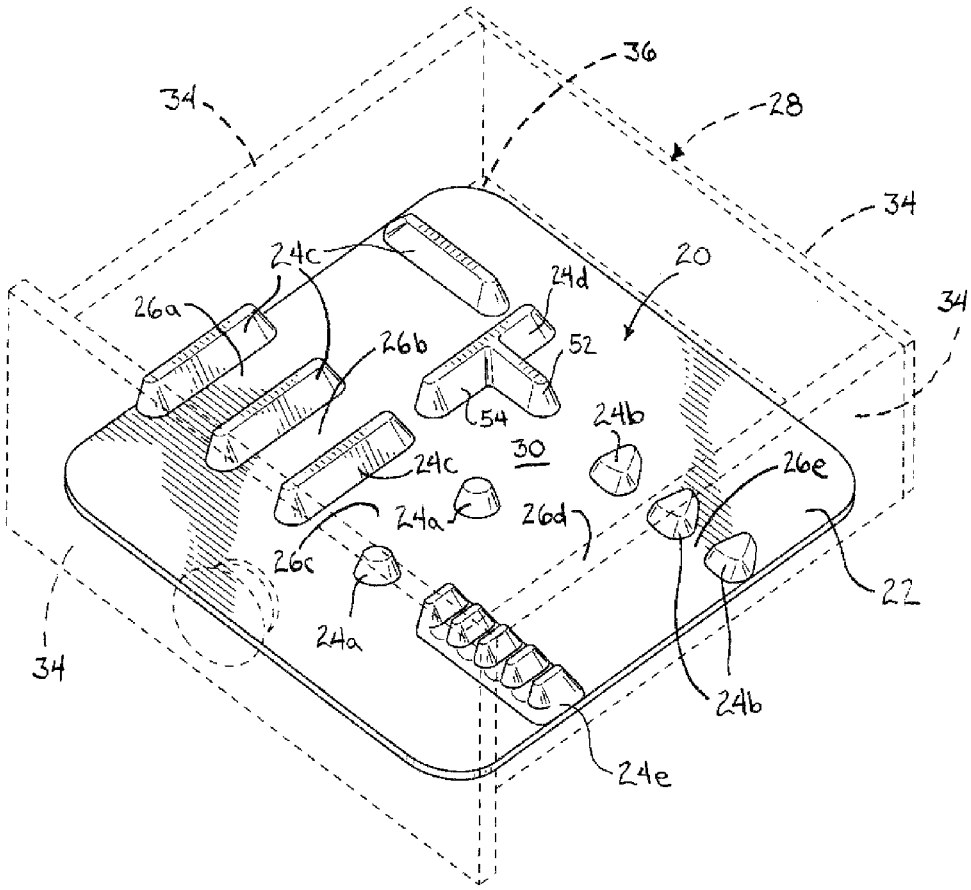
FIG. 10 is a perspective view of the drawer organizer of FIG. 1 shown installed within a drawer.
Figure 11:
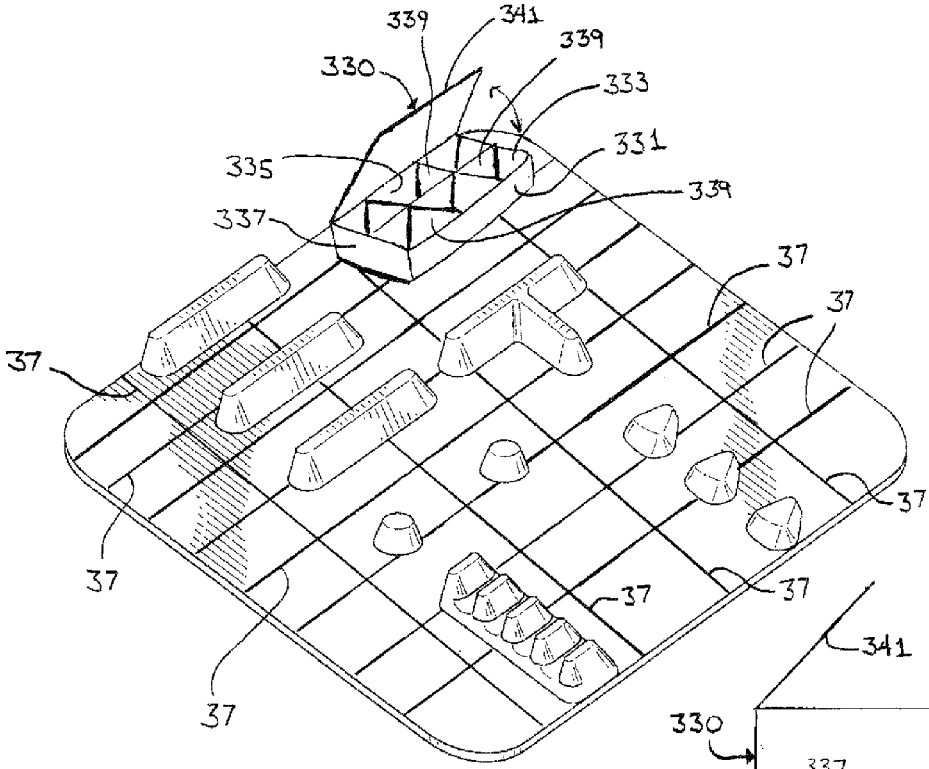
FIG. 11 is a perspective view of a drawer organizer substantially similar to the drawer organizer of FIG. 1 with an alternative retaining member formed as a storage compartment in accordance with the present invention positioned on the base liner.

Base liner of organizer 20 and 120 in the illustrated embodiment is constructed as a generally flat sheet or membrane of a pliable material, such as a polymeric material, including polyurethane or silicone, or other rubberized material. Base liner 22 includes an upper surface 30 and a bottom surface 32 and may be cut or trimmed, such as using scissors or the like, to a desired size or shape for installation in drawers of various shapes or lengths and widths. For example, as shown in FIG. 10, the base liner 22 may be trimmed such that it is in contact with or close proximity to all four vertical walls 34 of drawer 28, whereby the prevention of base liner 22 from slipping within drawer 28 is further aided. Still further, as shown in FIG. 11, base liner 22 may be provided with a pattern 37 to aid in cutting or trimming of liner 22 to create straight side edges. In the embodiment of FIG. 11, pattern 37 comprises multiple perpendicular lines, which lines may be added to base liner 22, such as by etching, or may alternatively be physically formed in base liner 22, such as by scoring surface 30 or 32 of base liner 22. Multiple base liners may be utilized together within a single drawer as needed depending on the size of the drawer and initial size of base liner. A typical drawer base surface, such as base surface 36 of FIG. 10, will be constructed of wood, wood laminate, plastic, or steel. The material of base liner 22, such as the materials noted above, provides a relatively high coefficient of friction between base liner 22 and base surface 36 whereby base liner 22 will resist or inhibit slipping relative to base surface 36, such as when drawer 28 is opened or closed. Base liner 22, therefore, will provide a non-slip member within drawer 28. Still further, the material of base liner 22 may be tacky or have tackiness as a material property, or be provided to have tackiness, such as by an adhesive member or coating or the like. The provision of tackiness to base liner 22 may aid or increase the non-slip characteristic of base liner within a drawer. Additionally, the provision of tackiness to base liner 22 may promote or enable the securing of retaining barriers 24 to base liner 22. An alternative base liner may be constructed as a more rigid member, such as from a generally planar plastic or metallic material. Base liners may also be provided with different textures, such as smooth, rough, ridged, or wavy. Such textures may also aid with retaining utensils thereon.

Figure 2A:
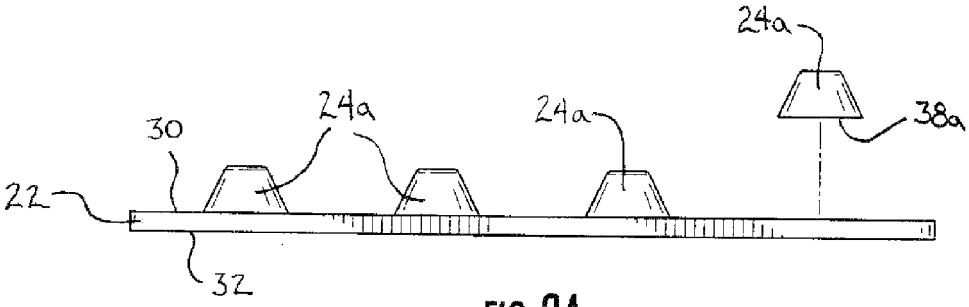
FIG. 2A is a front end view of the drawer organizer of FIG. 2.
Figure 2B:
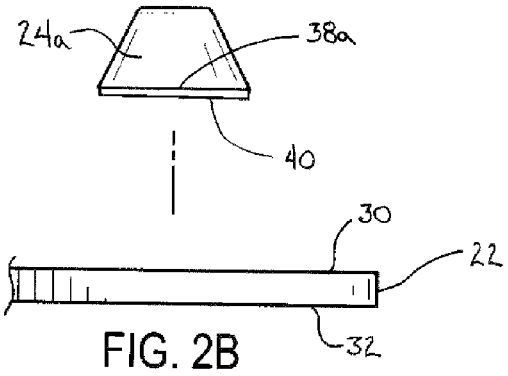
FIGS. 2B-2E are partial end views of one side of the drawer organizer of FIG. 2 illustrating various embodiments for connecting a retaining member to the base liner in accordance with the present invention.
Figure 2C:
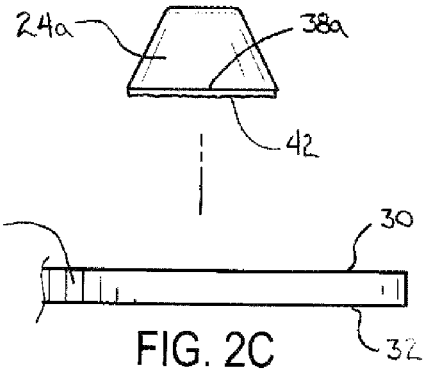

In the illustrated embodiments of FIGS. 1-10, numerous retaining members are identified by reference numerals 24*a*-24*n*, which may be collectively referred to for ease of reference as retaining members 24 without the letter identifier. It should be appreciated that numerous differently shaped retaining members 24 may be provided for flexibly customizing the configuration of a given drawer organizer 20 arrangement. Retaining members 24 include a generally planar or flat bottom surface, such as bottom surfaces 38*a* and 38*g* of FIGS. 2A and 3C, respectively. Retaining members 24 may be constructed of similar material to base liner 20, such as a polyurethane or silicone, or other rubberized material, and may be pliable whereby the retaining members 24 may be deformable into a desired shape or orientation. Alternative materials may be employed, such as plastics for example, and a retaining member may be generally rigid and not all retaining members of a given drawer organizer arrangement need be constructed of the same material. The bottom surfaces 38 of retaining members 24 may have or be provided with a tackiness characteristic whereby retaining members 24 may be affixed or stuck to base liner 20 and held there in place. As discussed above, the tackiness of the material of retaining member 24 and/or base liner 22 may be used to affix retaining members to upper surface 30 of base liner 22, or directly to the surface 26 of the drawer 28. This affixing via the tackiness of the material must be sufficient to secure the retaining members 24 in place, such as on base liner 22 when utensils are stored on the drawer organizer and the drawer 28 is opened and closed. As understood from FIGS. 2B and 2C, an adhesive member may also be applied to the bottom surface of a retaining member, such as to bottom surface 38*a* of retaining member 24*a* shown, to aid in temporarily or permanently affixing the retaining member 24*a* in a selected position on base liner 22. For example, adhesive member may be a double sided adhesive tape 40 (FIG. 2B) or may be a liquid or paste adhesive 42 (FIG. 2C), or the like, applied to bottom surface 38 and/or to base liner 22.

Figure 2D:
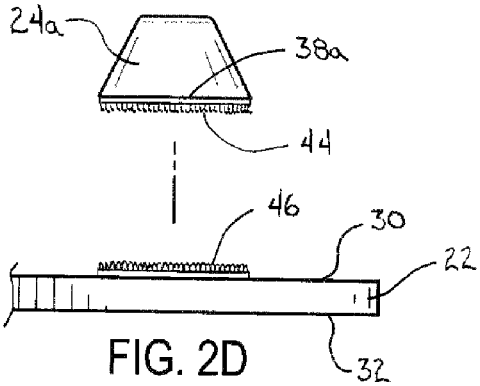
Figure 2E:
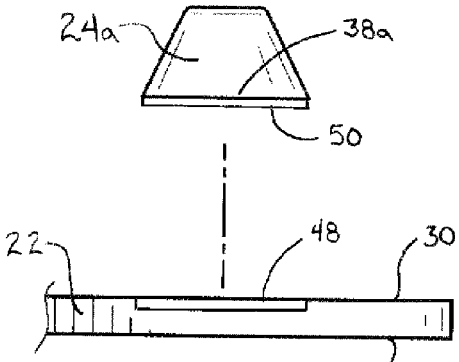

Retaining members 24 may be affixed to base liner 22 via alternative methods. For example, as illustrated in FIG. 2D, retaining member 24A may be adhered to base liner 22 by a hook and loop fastener arrangement, such as VELCRO®, where a loop portion 46 is applied to base liner 22 and a hook portion 44 is applied to bottom surface 38*a* of retaining member 24*a*, or vice versa. Retaining members 24 may also be affixed to base liners via magnetic attraction. As illustrated in FIG. 2E, base liner 22 may be provided with a magnetized or magnetic portion 48, such as a flexible magnetic material, and retaining member 24*a* may be provided with a portion 50, such as a metallic member or oppositely polarized magnetic material, that can be held to the magnetic portion 48. A still further alternative arrangement may employ a static attraction between retaining members and a base liner for affixing the retaining members in place.

The following description relative to FIGS. 1-7 provides discussion of the exemplary retaining members 24*a*-24*n*. Retaining member 24*a* of FIGS. 1 and 2 is disclosed as a round or generally frustoconical knob, and retaining member 24*b* is a generally triangular knob. Retaining members 24*c* of FIG. 1 is an elongate member having an approximately triangular cross section and rounded ends. Retaining member 24*d*, also of FIG. 1, includes a member 54 that is similar to retaining member 24*c*, but includes an additional member 52 projecting perpendicularly from member 54 whereby retaining member 24*d* is generally T-shaped as viewed from above when affixed to base liner 22. Retaining member 24*h* of FIG. 4A is generally similar to retaining member 24*d*, but includes a projecting perpendicular member 56 of longer length than member 52. Retaining member 24*e* of FIG. 1 may be used, for example, to receive a handle portion of a utensil, and includes a base portion or bottom member 58 for affixing to the base liner 22 and multiple upright members 60 projecting upwardly from the bottom member 58, with utensil receiving spaces or gaps 62 between the upright members 60.

Figure 3A:
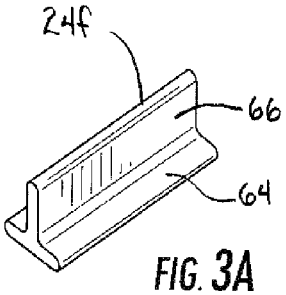
FIG. 3A is a perspective view of an embodiment of a retaining member in accordance with the present invention.
Figure 3C:
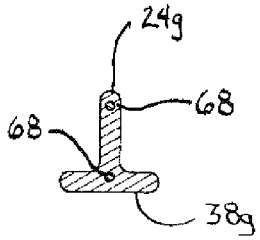
FIG. 3C is a cross-sectional view of the retaining member of FIG. 3B in accordance with the present invention.
Figure 3B:
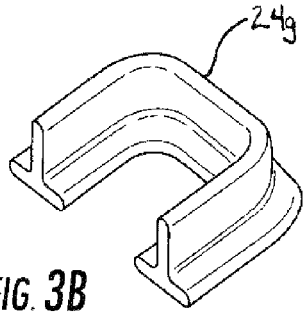
FIG. 3B is a perspective view of an alternative retaining member in accordance with the present invention.

With reference to FIG. 3A, retaining member 24*f* includes a horizontal portion 64 and a vertical portion 66 whereby retaining member 24*f* has a generally T-shaped cross section. As previously noted, retaining members may be pliable such that a retaining member may be deformed into a desired orientation. For example, retaining member 24*g* of FIG. 3B may be constructed of a pliable material whereby it may be formed into the orientation of FIG. 3B, or another form, or may be straightened to have a generally elongate orientation similar to that of retaining member 24*f*. Still further, a retaining member may include one or more deformable internal stiffener members or stiffening members, such as wires 68, within a retaining member, such as retaining member 24*g* as illustrated in FIG. 3C. Wires 68 may be employed to provide further support or retention to retaining member 24*g* when deformed into a desired shape to retain the retaining member in the desired shape. Although shown in connection with retaining member 24*g*, it should be appreciated that alternative retaining members may be provided with one or more stiffening members, such as a wire 68 or otherwise. For example, retaining members such as retaining members 24*c* or 24*j*, or otherwise, may be provided with such a stiffener.

Figure 4A:
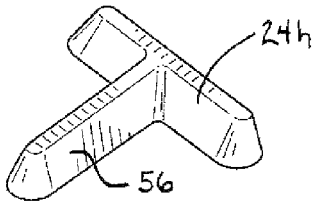
FIG. 4A is a perspective view of another embodiment of a retaining member in accordance with the present invention.
Figure 4B:
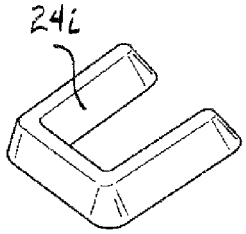
FIG. 4B is a perspective view of still another embodiment of a retaining member in accordance with the present invention.

Referring now to FIG. 4B, retaining member 24*i* is generally U-shaped as viewed from above when affixed to base liner 22. It should be appreciated that retaining member 24*i*, if constructed of a pliable material, may be selectively configured into alternative shapes, such as elongate, S-shaped, C-shaped, or the like.

Figure 5A:
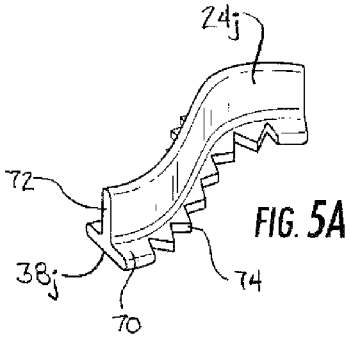
FIG. 5A is a perspective view of yet another embodiment of a retaining member in accordance with the present invention.
Figure 5B:
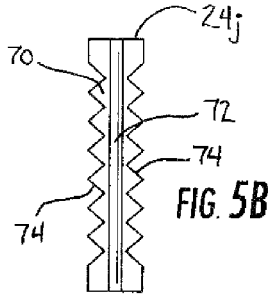
FIG. 5B is a top plan view of the retaining member of FIG. 5A.

FIGS. 5A and 5B illustrate yet another retaining member identified as retaining member 24*j*. Retaining member 24*j* has a generally T-shaped cross sectional profile and includes a horizontal portion 70 and an upright vertical portion 72, with the horizontal portion 70 including serrated edges 74. As understood from FIG. 5A, retaining member 24*j* is pliable or deformable whereby it may be shaped into a desired orientation. The inclusion of serrated edges 74 on horizontal portion 70 promotes the flexible shaping of retaining member 24*j* and aids in inhibiting the horizontal portion 70 from becoming undesirably wavy or bunched when flexed in a side-to-side direction, and in particular with respect to the segment of horizontal portion 70 on the concave side of vertical portion 72, whereby the bottom surface 38*j* of retaining member 24*j* may lie flat and fully contact base liner 22. Retaining member 24*j* may also include one or more stiffeners or stiffening members, such as a wire 68 as shown in FIG. 3C with respect to retaining member 24*g*.

Figure 6:
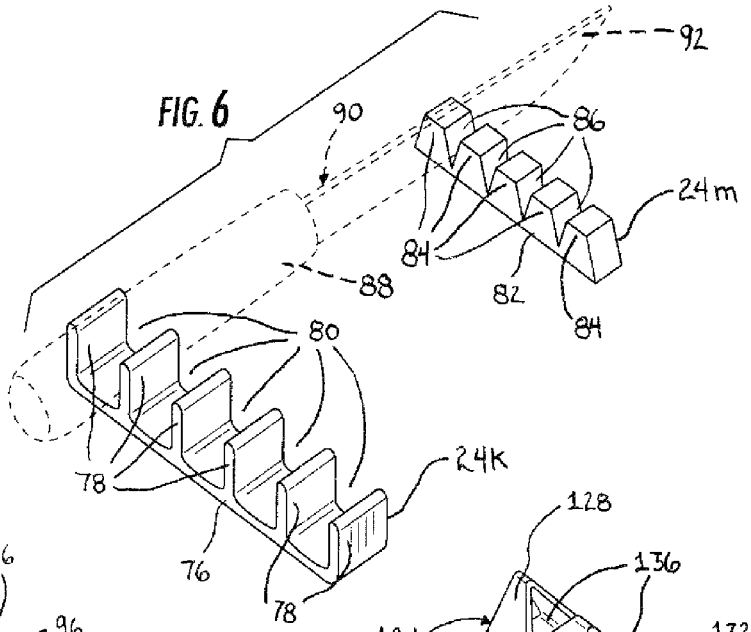
FIG. 6 is a perspective view of a pair of retaining members in accordance with the present invention shown cooperatively positioned for receiving a utensil.
Figure 7:
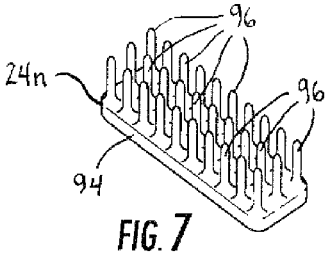
FIG. 7 is a perspective view of another embodiment of a retaining member.

Referring now to FIG. 6, retaining members 24*k* and 24*m*, in similar fashion to retaining member 24*e*, include a base portion or bottom member 76, 82, respectively, for affixing to the base liner 22 and multiple upright members 78, 84, respectively, projecting upwardly from the bottom member 76, 82, with utensil receiving spaces or gaps 80, 86 between the upright members 78, 84, respectively. Retaining members 24*k* and 24*m* may be arranged in coordinating fashion as shown in FIG. 6, such as on base liner 22, for example, whereby retaining member 24*k* receives the handle portion of utensils, such as the handle 88 of a knife 90, in gaps 80 between upright members 78, with the blade portion 92 of the knife 90 then being positioned and retained within the gaps 86 between upright members 84 of retaining member 24*m*. FIG. 7 illustrates yet another alternative retaining member 24*n* having a base portion 94 and multiple upright members 96, whereby utensils or portions of utensils may be placed between and held by the upright members 96.

Figure 8:
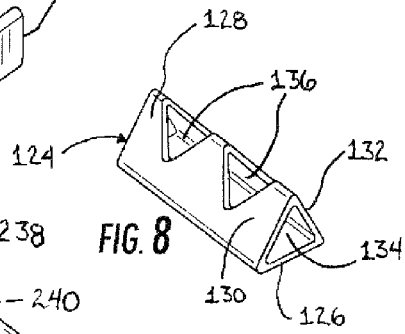
FIG. 8 is a perspective view an alternative retaining member in accordance with the present invention.
Figure 9:
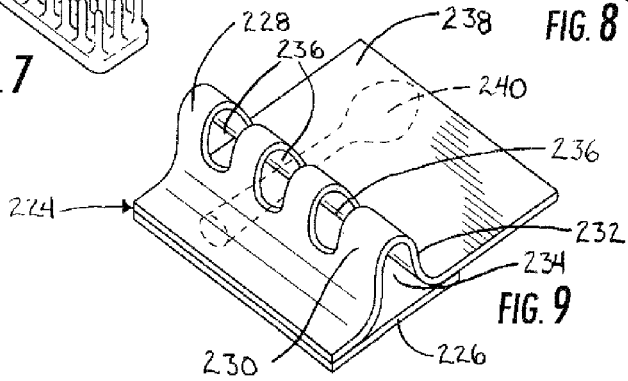
FIG. 9 is a perspective view of still another alternative retaining member in accordance with the present invention.

FIGS. 8 and 9 disclose still further alternative retaining barriers or retaining members 124 and 224. Retaining member 124 is generally triangular and includes a bottom portion 126 and a top portion 128, where the top portion 128 is formed by side members 130 and 132 to include cavity 134. Retaining member 124 further includes openings or apertures 136 formed in top portion 128. Accordingly, utensils or portions of utensils may be placed within apertures 136 of retaining member 124. Similarly, retaining member 224 includes a bottom portion 226 and a top portion 228, with top portion 228 including side members 230 and 232 to form cavity 234. Retaining member 224 further includes openings or apertures 236 formed in top portion 228 for receiving utensils, such as utensil 240 shown. In the illustrated embodiments of FIGS. 8 and 9, retaining member 124 is formed as a unitary piece, where as the bottom portion 226 and top portion 228 of retaining member 224 are formed of separate pieces that are joined together, such as by an adhesive. Retaining member 224 further includes an extended portion 238, which in the embodiment shown is formed as an extension of top portion 228, where extended portion 238 projects away from side member 232 and is able to receive and support a portion of utensil 240. Retaining members 124 and 224 may be affixed to a base liner 22 installed into a drawer 28, or alternatively may be inserted directly into a drawer 28 and affixed directly to the drawer bottom 36 without the use or independently of a base liner 22. Likewise, although shown and described above in connection with base liner 22, the various retaining members 24 may alternatively be affixed directly to a drawer bottom 32.

Figure 11A:
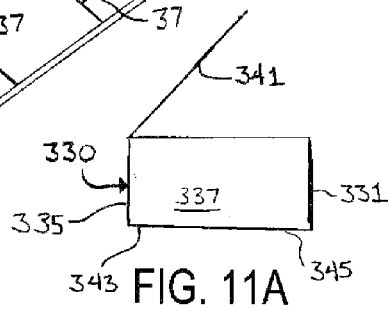
FIG. 11A is a side elevation view of the storage compartment of FIG. 11 shown removed from the base liner.

Referring now to FIGS. 11 and 11A, a drawer organizer that is of substantial similarity to drawer organizer 20 is illustrated with the retaining member 24*c* of the upper corner shown removed and yet another alternative retaining member shown mounted to base liner 22, where the alternative retaining member comprises a storage compartment 330. In the illustrated embodiment storage compartment 330 includes four external upright walls 331, 333, 335, and 337, multiple internal dividing walls 339, a pivotable lid 341, and a bottom member 343 having a planar surface 345 (FIG. 11A). Storage member 330 may be constructed of similar materials to those discussed above in regard to retaining members 24*a*-24*n*, or in similar manner to retaining member 24*p* discussed below, where for example, bottom member 343 may be constructed of a tacky plastic and upright walls 331, 333, 335 and 337 may be constructed of a rigid plastic. Accordingly, bottom member 343 may have a natural tackiness or be provided with tackiness and/or an adhesive to mount storage compartment to base liner 22. Still further, storage compartment 330 may be mounted via double sided tape, hook and loop connectors, or via magnetic or static attraction. As discussed above, FIG. 11 further illustrates the provision of pattern 37 on base liner 22.

Figure 12:
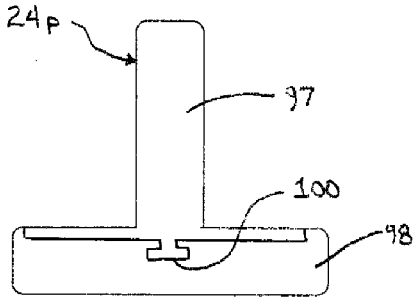
FIG. 12 is a cross sectional view of still another retaining member in accordance with the present invention.

FIG. 12 discloses still another retaining member identified as retaining member 24*p* comprising a composite retaining member. Retaining member 24*p* includes an upper portion 97 connected to a lower portion 98, where the upper portion 97 comprises a rigid member, such as a rigid plastic, and the lower portion 98 comprises a soft tacky portion, such as a tacky plastic material. A connector, such as T-connector 100, may be provided to aid in securing upper portion 97 to lower portion 98. Accordingly, the tackiness of the material of lower portion 98 may be used to affix retaining member 24*p* to the upper surface of a base liner. This affixing via the tackiness of the material must be sufficient to secure retaining member 24*p* in place on the base liner, or to the surface 36 of the drawer 28, when utensils are stored adjacent to the retaining member 24*p* and the drawer 28 is opened and closed.

The organizer in accordance with the present invention provides a configurable device to create a preferential arrangement for accommodating any of numerous types and styles of utensils that may be stored on the organizer, such as within a drawer. A base liner may be installed within the drawer, whereby any of variously shaped retaining members may be selectively arranged on the base liner to create a desired configuration for receiving utensils. The retaining members may be affixed to the base liner by the natural tackiness of the materials, or alternatively by way of an adhesive member, such as double sided tape or a liquid adhesive. Still further, hook and loop fasteners or magnetic elements may be employed for securing the retaining members. Alternatively, retaining members may be secured directly to the base surface of a drawer. The various utensils may include forks, knives, and spoons, as well as additional kitchen products, such as ladles, spatulas, and whisks, and other such hand tools or devices that may be stored in a drawer. The base liner and/or retaining members may also be provided in various colors and textures.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A drawer organizer for use in a drawer to receive items for storage, said drawer organizer comprising:

a base liner, said base liner having a rubberized planar upper surface and a bottom surface with said bottom surface being configured for installation on a base surface of a drawer;

a plurality of separate retaining members having rubberized planar bottom surfaces, said retaining members being selectively positionable and removably affixed to said rubberized planar upper surface of said base liner by an individual, wherein said retaining members are selectively positioned anywhere on said rubberized planar upper surface of said base liner and held in place via direct contact of said rubberized planar bottom surfaces with said rubberized planar upper surface in order to removably adhere and retain said retaining members in position on said base liner and thereby retain items in a desired position on said drawer organizer based on placement of said retaining members.

2. The drawer organizer of claim 1, wherein said base liner comprises a flexible mat.

3. The drawer organizer of claim 1, wherein said retaining members define receptacles between said retaining members for retaining items in a desired position on said rubberized planar upper surface of said base liner at said receptacles.

4. The drawer organizer of claim 1, wherein said rubberized planar bottom surfaces of said retaining members comprise polyurethane or silicone.

5. The drawer organizer of claim 1, wherein said rubberized planar upper surface of said base liner comprises polyurethane or silicone.

6. The drawer organizer of claim 1, wherein said retaining members include upper surfaces opposite said rubberized planar bottom surfaces, and wherein said upper surfaces define continuous surfaces free from apertures.

7. The drawer organizer of claim 1, wherein at least one of said retaining members comprises an elongate retaining member with said rubberized bottom surface of said elongate retaining member being elongate.

8. The drawer organizer of claim 7, wherein said elongate retaining member comprises a pliable elongate retaining member whereby an individual may deform said pliable elongate retaining member into a desired shape.

9. The drawer organizer of claim 8, wherein said pliable elongate retaining member is formed to include a stiffener member where said stiffener member is substantially encapsulated and located internally of said pliable elongate retaining member, said stiffener member being deformable and operating to promote retention of said pliable elongate retaining member in a desired shape.

10. The drawer organizer of claim 9, wherein said stiffener member comprises a wire insert.

11. The drawer organizer of claim 1, wherein said retaining members are formed from a rubberized material with said rubberized planar bottom surfaces being integrally formed with said retaining members.

12. The drawer organizer of claim 11, wherein said retaining members define whole bodies formed from a rubberized material.

13. The drawer organizer of claim 12, wherein said retaining members include upper surfaces opposite said rubberized planar bottom surfaces, and wherein said upper surfaces define continuous surfaces free from apertures.

14. The drawer organizer of claim 1, wherein said rubberized planar bottom surface of at least one of said retaining members is circular.

15. The drawer organizer of claim 1, wherein at least one of said retaining members has a shape comprising at least one selected from the group consisting of a T-shape or U-shape as viewed from above when affixed to said base liner.

16. The drawer organizer of claim 1, wherein at least one of said retaining members has a bottom portion and a top portion, said top portion being positioned above said bottom portion to form a cavity between said top portion and said bottom portion, and wherein said top portion includes at least one aperture for receiving an item for storage and said bottom portion being selectively affixed to said upper surface of said base liner.

17. The drawer organizer of claim 1, wherein at least one of said rubberized planar bottom surfaces of said retaining members or said rubberized planar upper surface of said base liner are tacky.

18. A method of organizing a drawer, said method comprising:

providing a base liner for insertion into a drawer, said base liner having a rubberized planar top surface and a bottom surface;

inserting said base liner into a drawer such that said bottom surface contacts a base surface of the drawer; and selectively affixing a plurality of retaining members to said top surface of said base liner to create receptacles for receiving items for storage, wherein said retaining members include rubberized planar bottom surfaces with said rubberized planar bottom surfaces of said retaining members being selectively positioned anywhere on said rubberized planar upper surface of said base liner wherein said retaining members are removably adhered and retained in place via direct contact of said rubberized planar bottom surfaces with said rubberized planar upper surface.

19. The method of claim 18, wherein said base liner is flexible whereby said base liner may be trimmed for insertion into the drawer.

20. A drawer organizer for use in a drawer to receive items for storage, said drawer organizer comprising:

at least one retaining member having a bottom portion and a top portion, with said top portion being positioned above and joined with said bottom portion to form a cavity between said top portion and said bottom portion, and wherein said top portion includes at least one aperture for receiving an item for storage and said bottom portion includes a rubberized planar bottom surface; and a base liner, said base liner having a rubberized planar upper surface and a bottom surface with said bottom surface being configured for installation on a base surface of a drawer, and wherein said rubberized planar bottom surface of said bottom portion of said retaining member is selectively affixed anywhere on said planar upper surface of said base liner with said retaining member being removably adhered and retained in place via direct contact of said rubberized planar bottom surface with said rubberized planar upper surface of said base liner.

21. The drawer organizer of claim 1, wherein said rubberized planar bottom surfaces of said retaining members and said rubberized planar upper surface of said base liner are both constructed of the same rubberized material thereby promoting adhesion there between.

* * * * *